US010030654B2

(12) United States Patent
Svenheim

(10) Patent No.: US 10,030,654 B2
(45) Date of Patent: Jul. 24, 2018

(54) LIQUID RING SCREW PUMP FUNCTIONAL DESIGN

(71) Applicant: JETS AS, Hareid (NO)

(72) Inventor: Ole Asgeir Svenheim, Lonevag (NO)

(73) Assignee: JETS AS, Hareid (NO)

( * ) Notice: Subject to any disclaimer, the term of this patent is extended or adjusted under 35 U.S.C. 154(b) by 284 days.

(21) Appl. No.: 14/891,545

(22) PCT Filed: May 15, 2014

(86) PCT No.: PCT/NO2014/000033

§ 371 (c)(1),
(2) Date: Nov. 16, 2015

(87) PCT Pub. No.: WO2014/185786

PCT Pub. Date: Nov. 20, 2014

(65) Prior Publication Data

US 2016/0090982 A1 Mar. 31, 2016

(30) Foreign Application Priority Data

May 16, 2013 (NO) ..... 20130692

(51) Int. Cl.

| | |
|---|---|
| ***F04C 7/00*** | (2006.01) |
| ***F04C 19/00*** | (2006.01) |
| ***F04C 27/02*** | (2006.01) |

(52) U.S. Cl.

CPC ..... *F04C 7/00* (2013.01); *F04C 19/00* (2013.01); *F04C 27/02* (2013.01); *F04C 2250/00* (2013.01)

(58) Field of Classification Search

CPC .. F04D 3/02; F04C 7/00; F04C 19/00–19/008

USPC ..... 417/68, 69

See application file for complete search history.

(56) References Cited

U.S. PATENT DOCUMENTS

| | | | | |
|---|---|---|---|---|
| 4,810,174 | A * | 3/1989 | Stuckey | F04D 29/628 415/912 |
| 5,344,085 | A * | 9/1994 | Hofseth | E03F 1/006 241/46.02 |
| 5,375,980 | A | 12/1994 | Johst et al. | |
| 5,395,210 | A | 3/1995 | Yamazaki et al. | |

(Continued)

FOREIGN PATENT DOCUMENTS

| | | |
|---|---|---|
| DE | 2153038 A1 | 5/1972 |
| EP | 0111653 A2 | 6/1984 |

(Continued)

OTHER PUBLICATIONS

Nordic Patent Institute; Search Report in International Patent Application No. PCT/NO2013/050064 dated Aug. 4, 2014; 2 pages.

*Primary Examiner* — Alexander Comley
(74) *Attorney, Agent, or Firm* — Wood Herron & Evans LLP

(57) ABSTRACT

A liquid ring screw pump includes a housing with a suction inlet section and a pressure outlet section. Within the housing an Archimedes screw rotor is driven by a motor via a shaft. The inlet section and outlet section are each provided with connecting structure for suction and pressure piping respectively. The displacement CD of the screw rotor in relation to the center axis of the housing is determined by an equation based on the screw rotor radius, a minimum screw rotor core radius, and a variable k that is between 0.14 and 0.29.

1 Claim, 4 Drawing Sheets

(56) References Cited

U.S. PATENT DOCUMENTS

| | | | | |
|---|---|---|---|---|
| 7,946,828 | B2 * | 5/2011 | Ovsthus | F04C 27/009 277/379 |
| 8,944,778 | B2 * | 2/2015 | Lappalainen | F04C 19/005 4/431 |
| 9,097,257 | B2 * | 8/2015 | Ovsthus | B02C 18/0092 |
| 2007/0172366 | A1 * | 7/2007 | Ovsthus | F04C 19/00 417/423.11 |
| 2013/0089440 | A1 * | 4/2013 | Lappalainen | F04C 19/005 417/54 |
| 2014/0119975 | A1 * | 5/2014 | Ovsthus | B02C 18/0092 418/205 |

FOREIGN PATENT DOCUMENTS

| | | | |
|---|---|---|---|
| EP | 0287350 | A2 | 10/1988 |
| EP | 0454794 | B1 | 11/1991 |
| FR | 977137 | A | 3/1951 |
| WO | 20040099619 | A1 | 11/2004 |
| WO | 2012115521 | A1 | 8/2012 |
| WO | 2012173488 | A1 | 12/2012 |

* cited by examiner

LIQUID RING SCREW PUMP FUNCTIONAL DESIGN

TECHNICAL FIELD

The present invention relates to a liquid ring screw pump design, including a housing with a suction inlet part and a pressure outlet part and within the housing rotatably provided Archimedes screw driven by a motor via a shaft.

BACKGROUND

Pumps of the above-mentioned kind are now commonly used in vacuum sewage systems onboard ships, aero planes and trains. However, such systems are also increasingly being used on land due to reduced water requirement and easy handling and treatment of waste water, as well as its flexibility as regards installation of piping and layout given by such systems.

The applicant of the present application introduced in 1987, cf. EP Patent No. 0287350, for the first time the novel vacuum sewage system where the vacuum in the system was generated by means of a liquid ring screw pump of this kind where the pump is used as well to discharge the sewage from a vacuum tank or the like to which it is connected.

EP Patent No. 0454794, also filed by the applicant, further shows a revolutionary improvement of a vacuum sewage system where the liquid ring screw pump is provided with a grinder or macerator and is connected directly with the suction pipe of the system, whereby vacuum is generated in the sewage suction pipe and sewage is discharged directly from the system by means of the pump.

The present invention may, or may not include such grinder provided at the inlet end of the Archimedes screw rotor.

Liquid ring screw pumps of the above-mentioned type commonly comprise a housing with a suction inlet part at one end and a pressure outlet part at the other end and within the housing rotatably provided Archimedes screw (screw rotor) which is driven by an electric motor via a shaft. In the known prior art pump and motor, as for instance shown in the above EP Patent No. 0454794, the rotor is commonly provided at or close to the centre axis of the pump housing.

SUMMARY

With the present invention is provided a liquid ring screw pump with improved design where the efficiency is increased by several percent (%) compared to existing pump designs by optimizing the displacement of the screw rotor within the pump housing.

BRIEF DESCRIPTION OF THE DRAWINGS

The invention will be further described in the following by way of examples and with reference to the drawings where.

DETAILED DESCRIPTION

Figure 1:
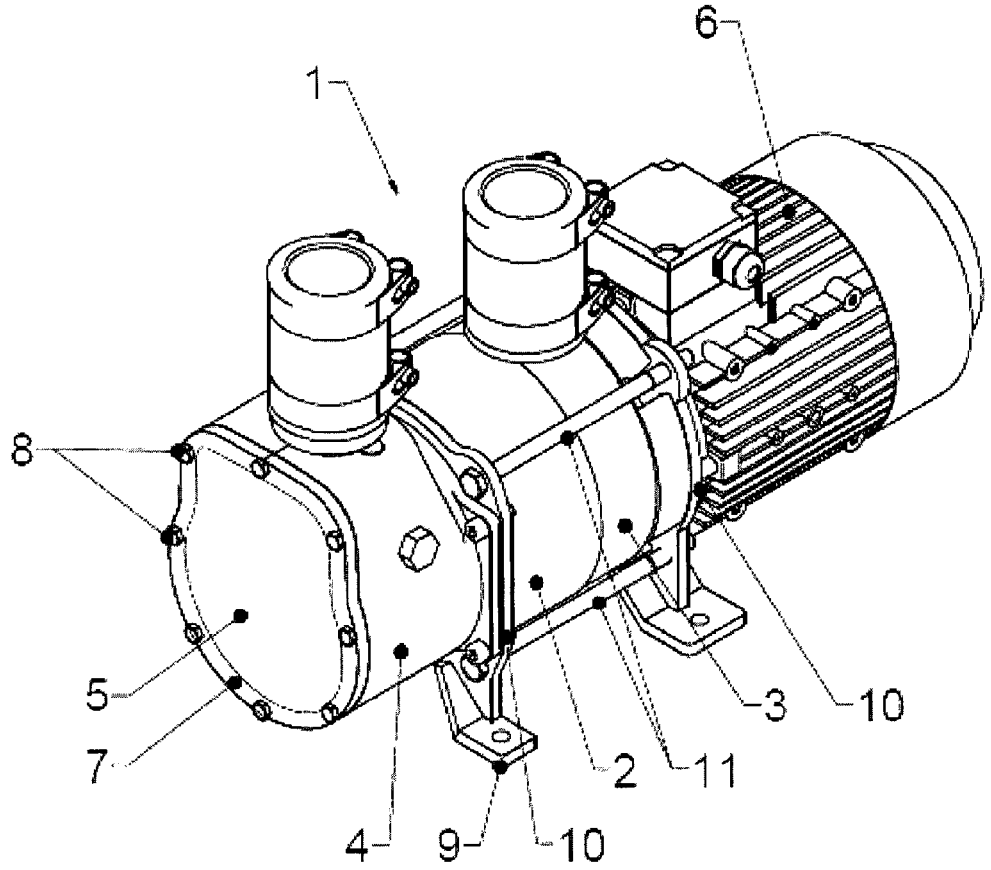
FIG. 1 shows a liquid ring screw pump according to the invention.

FIG. 1 shows, as stated above, an example of a liquid ring screw pump 1 including a housing 2 with a suction inlet section 4 at one end and a pressure outlet section 3 at the other end and within the housing 2 rotatably provided Archimedes screw (not shown) driven by a motor 6 via a shaft (neither not shown). The inlet section 4 further includes a suction chamber which is provided with a front cover or lid 5 which is fastened to the suction chamber by means a flange connection 7 with a plurality of screw and nuts 8. In the present example the pump including the motor is provided with two pairs of legs or supports 9, whereof one leg or support 9 for each pair is shown in the figures (the legs on the other side are not shown). In this connection it should be noted that some known solution even may have three or more pair of legs including at least one for the motor 6. The legs or supports 9 of the solution shown in FIG. 1 are provided on intermediate ring elements 10.

The housing 2 with the suction inlet section 4 and pressure outlet section 3 are detachably held together by means of longitudinally provided bolts 11 through said intermediate elements 10.

Figure 2:
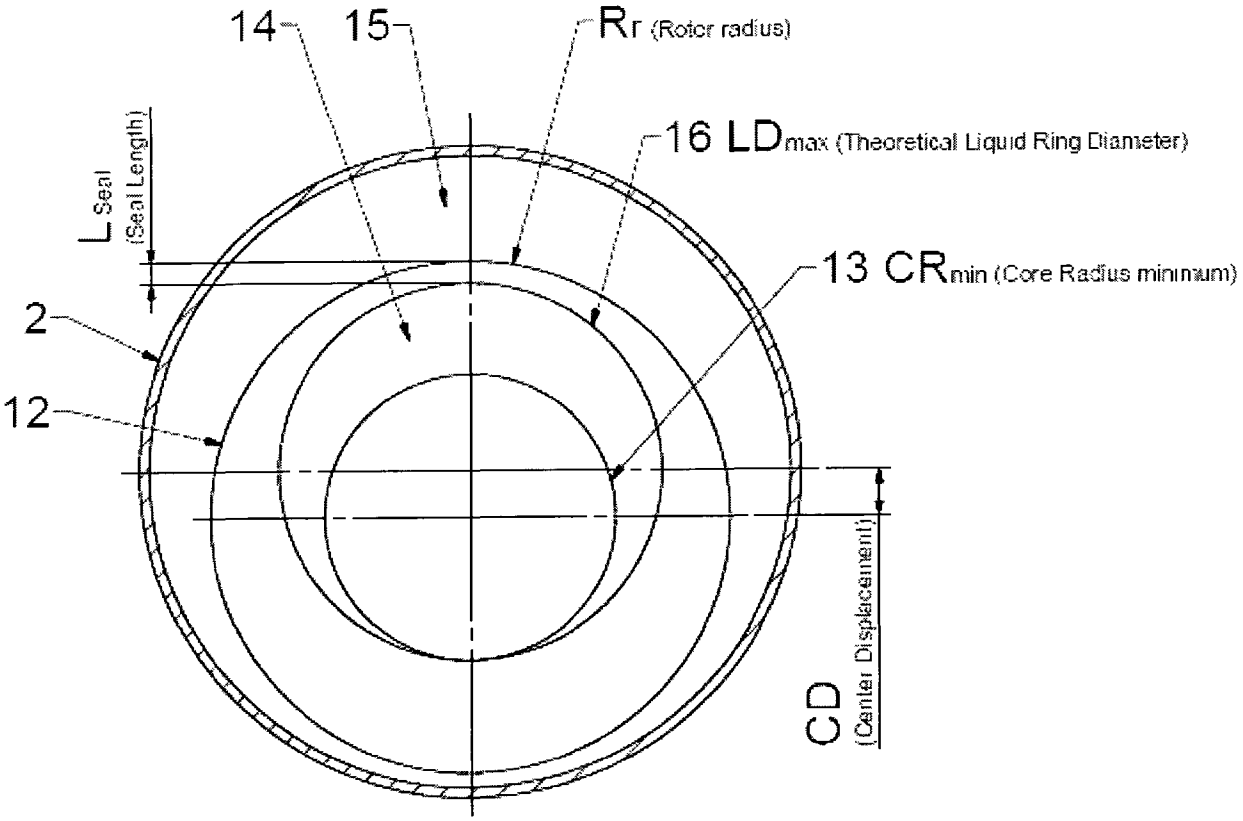
FIG. 2 shows in larger scale a cross section of the pump shown in FIG. 1.

FIG. 2 shows a cross section of the pump as shown in FIG. 1 comprising the rotor housing 2, the screw rotor 12 and the rotor core 13. Reference numeral 14 indicates the air pocket and 15 indicates the liquid ring 16 which are generated under running conditions of the pump. The inventors were aiming at finding a relationship between the screw rotor 12 diameter, the rotor core 13 diameter and the displacement, CD of the rotor 12 axis in relation to the axis of the rotor housing 2.

The inventors found through theoretical evaluations and testing that the relationship could be found by an equation defined by a range, k, representing an area or range where the pump efficiency is optimal. Since the k defines as an area, it is not possible to determine an exact value of the displacement, but a range within which the pump will have its optimal efficiency and capacity.

Referring to FIG. 2, the inventors developed a set of equations to determine the optimized range of displacement of the screw rotor within the housing:

$$\frac{L_{seal}}{CR_{min}} = k$$

$$k * CR_{min} = L_{seal}$$

$$R_{r+CR_{min}-L_{seal}} = LD_{max}$$

$$\frac{L_{max}}{2} - CR_{min} = CD$$

And to further determine the range k, the inventors arrived at the following equation:

$$\frac{R_r - CR_{min} - 2CD}{CR_{min}} = k$$

where:

$R_r$ is the screw rotor radius $CR_{min}$ is the screw rotor core radius, minimum CD is the center displacement, and k is a range.

Figure 3:
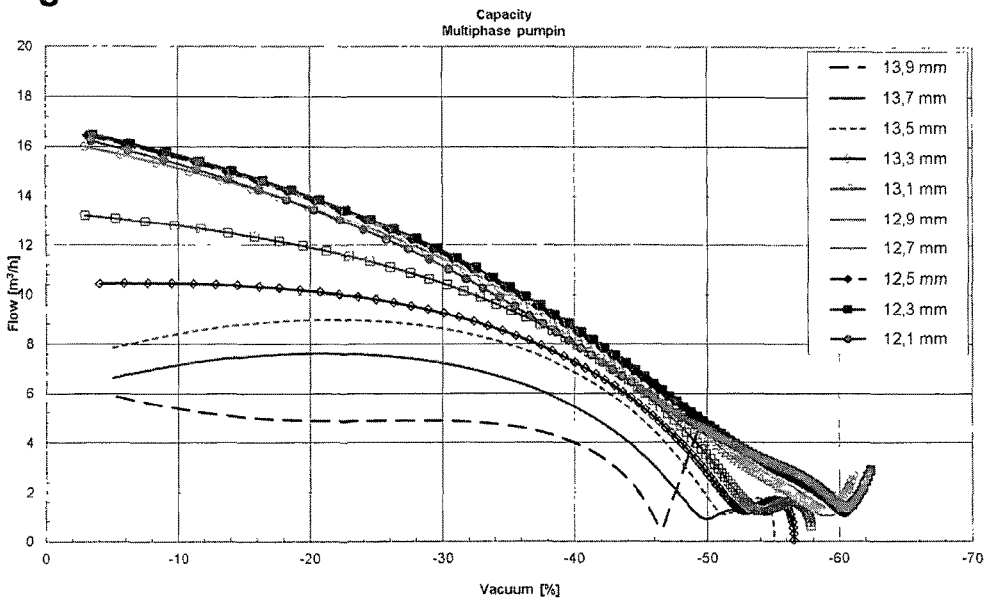
FIG. 3 is an illustration showing capacity curves, i.e. the pumped volume of fluid (liquid and air) vs. pump suction vacuum in relation to pump rotor centre (axis) displacement.

To find the lower value of the range k, tests were carried out with a liquid ring screw pump where only the displacement of the rotor in relation to the pump housing was done. All other design features were un-changed. For each test the displacement of the rotor was 0.2 mm and the capacity in $m^2/h$ was measured in relation to the vacuum (% below atmosphere) at the suction side of the pump. FIG. 3 shows the result of the tests and as can be seen the capacity curves changes notably at a centre displacement from 13.3 to 13.5, and when CD is larger than 13.4 the value at 5 percent vacuum is lower than the values at 10 percent and 20 percent.

To find the upper value of the range, k, further tests were done where the CD was changed stepwise with 0.2 mm. The results of the tests are depicted in FIG. 4, and as can be seen there is a "jump" in the curves and thereby a notable change in capacity from 11.3 to 11.1 mm.

Figure 5:
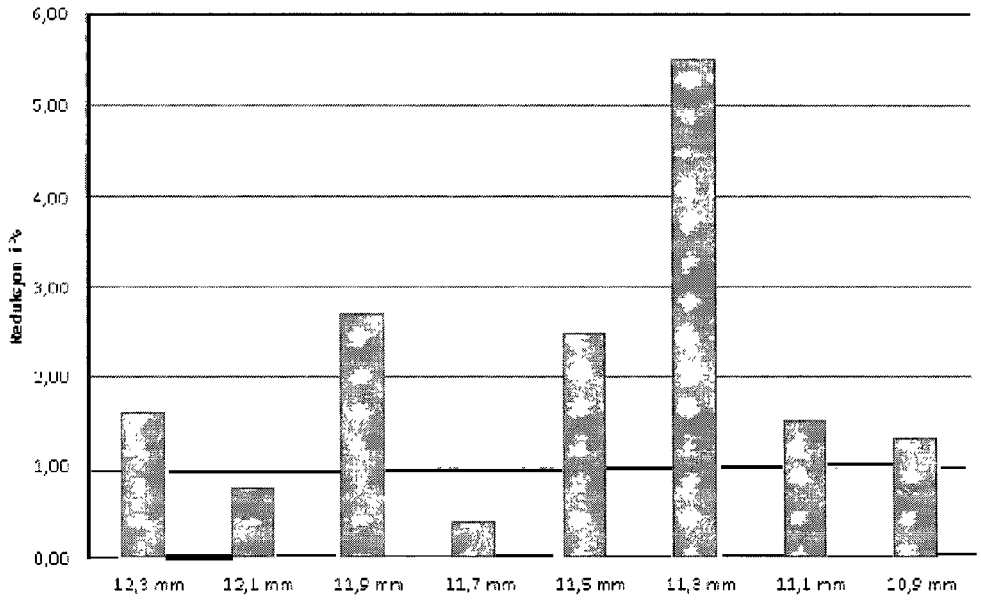
FIG. 5 is a bar chart, based on tests, showing the percentage of change of capacity on the basis of each step of displacement of the pump rotor.

The bar chart in FIG. 5 shows how much in percentage the capacity changes for each change of displacement by 0.2 mm.

Figure 4:
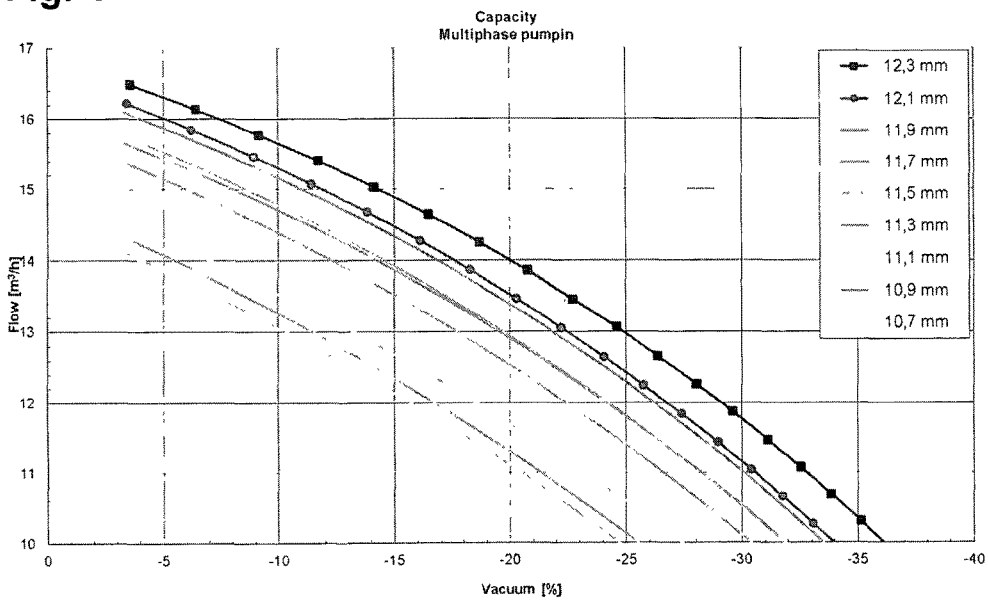
FIG. 4 shows the same illustration with different rotor axis displacement.

Based on the performed tests when increasing and reducing the CD of the screw rotor, one can see that the curves in FIGS. 3 and 4 changes notably when the CD is larger than 13.3 and lower than 11.3. By applying these results in the empirical equation developed by the inventors as mentioned above, the following result are obtained:

$$\frac{R_r - CR_{min} - 2CD}{CR_{min}} = k$$

When putting the registered/noted numbers in the equation, the range, k, is calculated to be as follows:

$$\frac{57.5 - 27 - 2 * 13.3}{27} = 0.14$$

-continued $$\frac{57.5 - 27 - 2 * 11.3}{27} = 0.29$$

This implies that the liquid ring screw pump has its optimum capacity when the range, k, is between 0.14 and 0.25.

What is claimed is:

1. A liquid ring screw pump comprising, a housing with a suction inlet section and a pressure outlet section; and an Archimedes screw rotor rotatably disposed within the housing and driven by a motor via a shaft;

wherein a displacement CD of the screw rotor in relation to a center axis of the housing is determined on the basis of the equation:

$$\frac{R_r - CR_{min} - 2CD}{CR_{min}} = k$$

where:

$R_r$ is the screw rotor radius, $CR_{min}$ is the screw rotor core minimum radius, CD is the center displacement, and k is a range, wherein the range k is between 0.14 and 0.29.

* * * * *